US006823533B2

(12) United States Patent
Casari

(10) Patent No.: US 6,823,533 B2
(45) Date of Patent: Nov. 30, 2004

(54) ODOR ABSORBER DEVICE FOR URINAL

(76) Inventor: Derek Casari, 15477 Dickens St., Sherman Oaks, CA (US) 91403

( * ) Notice: Subject to any disclaimer, the term of this patent is extended or adjusted under 35 U.S.C. 154(b) by 98 days.

(21) Appl. No.: 10/405,286

(22) Filed: Apr. 3, 2003

(65) Prior Publication Data

US 2004/0194198 A1 Oct. 7, 2004

(51) Int. Cl.[7] ..... E03D 13/00
(52) U.S. Cl. ..... 4/309; 4/222.1
(58) Field of Search ..... 4/222, 222.1, 231, 4/309, 314, DIG. 5

(56) References Cited

U.S. PATENT DOCUMENTS 3,597,772 A * 8/1971 Leavitt et al. ..... 4/222
4,103,367 A * 8/1978 Kaufer ..... 4/222
5,336,424 A * 8/1994 Van Vlahakis et al. ..... 510/101
5,365,616 A * 11/1994 Morad ..... 4/309
6,640,350 B1 * 11/2003 Deutsch ..... 4/309

* cited by examiner

*Primary Examiner*—Gregory L. Huson
*Assistant Examiner*—Huyen Le

(57) ABSTRACT

Odor Absorber Device for Urinal with an odor absorbing cake retaining device, the device including a flexible base plate and an integral raised, circular cake retaining wall, a standard odor absorbing cake and a thermochromic graphic display panel mounting on top of the odor absorbing cake. The base plate and the lower portion of the retaining wall have a plurality of apertures to allow the cake to be effective. The circular retaining wall has a non perforated upper portion. The retaining wall has an inwardly facing ledge integrally attached to the top surface of the retaining wall. The base plate has a frame member capable of removably retaining an advertising display panel.

1 Claim, 2 Drawing Sheets

ODOR ABSORBER DEVICE FOR URINAL

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of urinal accessories and more specifically to an odor absorber device for a urinal. Public urinals can become undesirable from and odor point of view if no odor absorbing materials are used. Odor absorbing devices are currently found in most public urinals at this time. They are traditionally made of a plastic base plate and an integral raised circular wall capable or retaining a standard odor absorbing cake.

Another problem is that if a person does not aim properly when urinating into a urinal it can cause an unpleasant cleaning problem for those responsible for cleaning the bathroom.

Existing odor absorbing devices for urinals do not have an interesting and enjoyable means to provide an incentive for the user to aim properly into the urinal. Additionally, existing odor absorbing devices do not have a means for an advertising panel to be removably attached.

BRIEF SUMMARY OF THE INVENTION

The primary object of the invention is to provide an odor absorbing device for urinals that promotes the user to aim at the center of the urinal.

Another object of the invention is to provide an odor absorbing device that includes a means for an advertising display to be affixed to the device.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an odor absorber device for a urinal comprising: an odor absorbing cake retaining device, said device including a flexible base plate and an integral raised, circular cake retaining wall, a standard odor absorbing cake and a thermochromic target display panel mounted on top of said odor absorbing cake. Said base plate and the lower portion of said retaining wall have a plurality of apertures to allow said cake to be effective. Said circular retaining wall has a non perforated upper portion. The said retaining wall has an inwardly facing ledge integrally attached to the top surface of said retaining wall, and said base plate has a frame member capable of removably retaining an advertising display.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
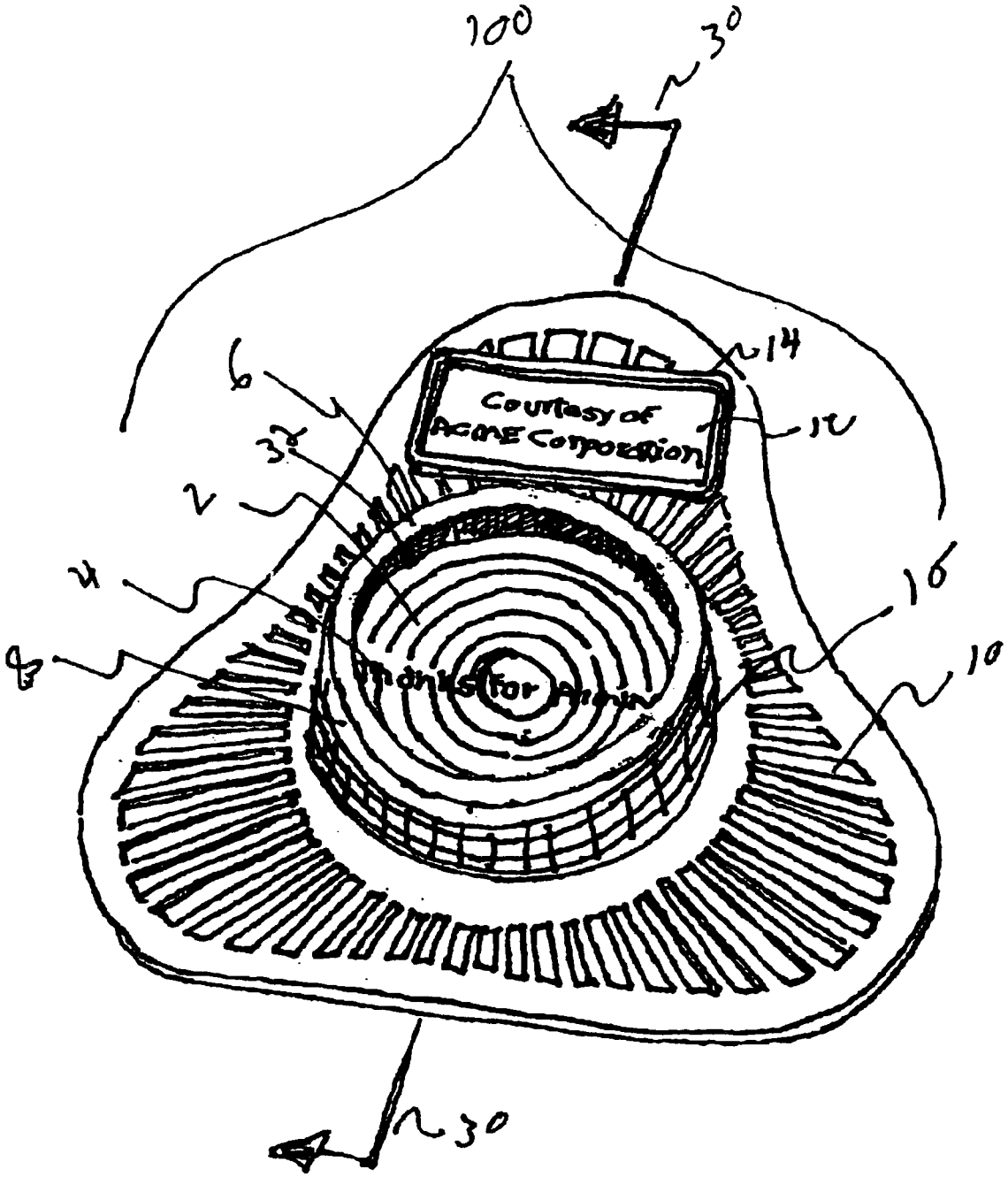
FIG. 1 is a perspective view of the invention
Figure 2:
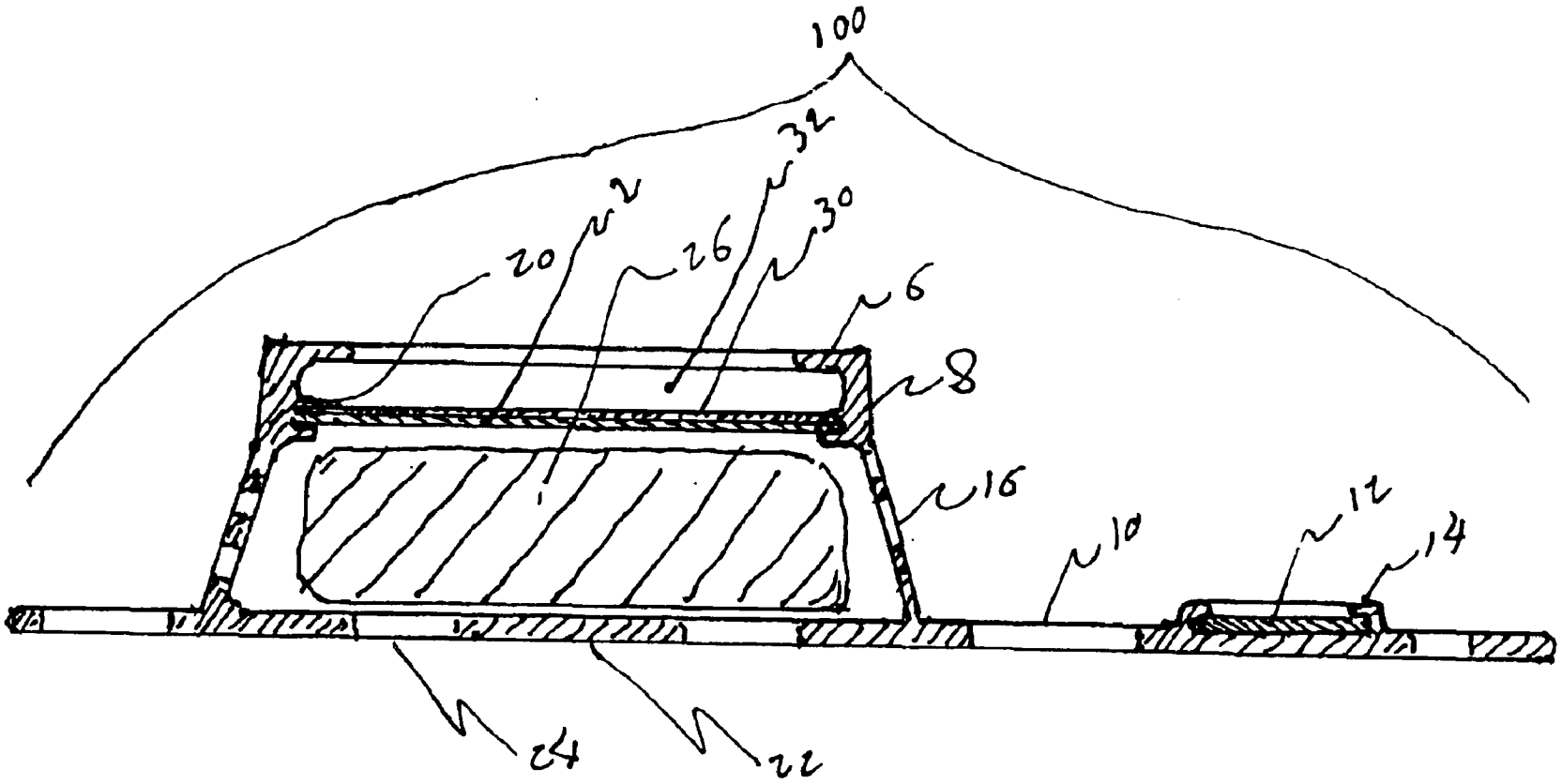
FIG. 2 is a side section view of the present invention

Referring now to FIG. 1 we see a perspective view of the odor absorbing device of the present invention 100. The base plate 10 is made of flexible plastic that has a plurality of apertures for allowing urine to exit the urinal. An integral raised circular wall 16 also has a plurality of apertures in the bottom two thirds of the wall and is solid at the top third of the wall 8. A removable and replaceable graphic panel 2 has a target printed on it and has thermochromic material applied over the graphic so that urine, at a temperature of approximately ninety degrees will turn the normally opaque thermochromic material into a clear material thereby revealing the target graphic 2 underneath. Alternately, the graphic panel 2 can include an advertising design rather than the target graphic. The Graphic 2 shown also has the words "Thanks for Aiming" 4 printed on it. The graphic panel 2 is recessed inside wall area 8 so that urine can collect in the depressed area 32 thereby providing a uniform warm liquid to cause the thermochromic material to turn clear. The raised wall 8 has an inwardly facing flange 6 that helps keep urine from splashing out of the depressed area inside wall 8. Flat base panel 10 also includes a frame member 14 that can removably retain a printed panel 12 that can include the name of a sponsoring company. Section view line 30 indicates the section view shown in FIG. 2. In this view odor absorbing cake 26 is retained within raised wall 16. Recessed area 20 can removably retain graphic panel 2. Thermochromic covering 30 is also shown. Flat panel 10 continues under cake 26 having solid portions 22 and open portions 24. Advertising panel 12 is shown being retained by integral frame 14. The upper portion of wall 8 is shown thereby creating a liquid retaining depression 32 that can temporarily retain urine thereby insuring that the heat from the urine can cause the thermochromic material 30 to become clear. In the above described an illustrated way, it is clear that the present invention is a new and novel way to encourage a user to aim at the target provided thereby reducing the possibility of urine leaving the confines of the urinal. Additionally, the advertising panel can provide an additional revenue for the institution where the urinal resides.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Odor Absorber Device for Urinal comprising:

an odor absorbing cake retaining device;

said device including a flexible base plate and an integral raised, circular cake retaining wall;

a standard odor absorbing cake;

a thermochromic display panel removably and replacealby mounted on top of said odor absorbing cake;

said base plate and the lower portion of said retaining wall having a plurality of apertures to allow said cake to be effective;

said circular retaining wall having a non perforated upper portion;

said retaining wall having an inwardly facing ledge integrally attached to the top surface of said retaining wall; and said base plate having a frame member capable of removably retaining an advertising display.

* * * * *